US006195980B1

(12) United States Patent
Walther

(10) Patent No.: US 6,195,980 B1
(45) Date of Patent: Mar. 6, 2001

(54) ELECTROSTATIC PROPULSION ENGINE WITH NEUTRALIZING ION SOURCE

(75) Inventor: Stephan Walther, Kirchweyhe (DE)

(73) Assignee: DaimlerChrysler Aerospace AG, Munich (DE)

( * ) Notice: Subject to any disclaimer, the term of this patent is extended or adjusted under 35 U.S.C. 154(b) by 0 days.

(21) Appl. No.: 09/361,888

(22) Filed: Jul. 27, 1999

(30) Foreign Application Priority Data

Aug. 6, 1998 (DE) ..... 198 35 512

(51) Int. Cl.[7] ..... F03H 1/00
(52) U.S. Cl. ..... 60/202
(58) Field of Search ..... 60/202

(56) References Cited

U.S. PATENT DOCUMENTS 3,789,253 * 1/1974 Kervizic et al. ..... 250/492.1
4,264,813 * 4/1981 Chandrashekhar et al. ..... 250/288
4,719,355 * 1/1988 Meyers et al. ..... 250/425
4,783,595 * 11/1988 Seidl ..... 250/423 R
4,838,021 * 6/1989 Beattie ..... 60/202
5,211,006 * 5/1993 Sohnly ..... 60/202
5,947,421 * 9/1999 Beattie et al. ..... 244/172
6,121,569 * 9/2000 Miley et al. ..... 219/121.48

* cited by examiner

*Primary Examiner*—Charles G. Freay
*Assistant Examiner*—Robert Z. Evora
(74) *Attorney, Agent, or Firm*—W. F. Fasse; W. G. Fasse

(57) ABSTRACT

An electrostatic ion propulsion engine for satellites and spacecraft is equipped with an electron source for neutralizing the propellant gas ion beam or jet emitted by the engine. The electron source includes an anode housing, a hollow cathode tube with gas flowing therethrough, a cathode element at the outlet end of the cathode tube within the interior space of the anode housing, and a pin- or rod-shaped auxiliary electrode arranged along the lengthwise axis in the hollow cathode tube. An ignition pulse is applied to the auxiliary electrode relative to the cathode tube, which causes a pulse discharge in the cathode tube, and in turn ignites the gas discharge between the anode and the cathode which generates the electron current.

17 Claims, 2 Drawing Sheets

ELECTROSTATIC PROPULSION ENGINE WITH NEUTRALIZING ION SOURCE

PRIORITY CLAIM

This application is based on and claims the priority under 35 U.S.C. §119 of German Patent Application 198 35 512.2, filed on Aug. 6, 1998, the entire disclosure of which is incorporated herein by reference.

FIELD OF THE INVENTION

The invention relates to an electrostatic propulsion engine and particularly an ion engine for use in satellites and spacecraft, including an apparatus for ionizing a propellant gas, an apparatus for accelerating the propellant gas ions, and an electron source of which the output electrons are coupled or directed into the propellant ion jet for the purpose of neutralizing the same.

BACKGROUND INFORMATION

In conventional electrostatic propulsion engines of the above mentioned general type, atoms of a propellant gas expelled from a supply container or tank are first ionized to form positively charged propellant ions, and then these ions are accelerated in an electrostatic high voltage field to form a high-energy beam or jet of the ions which in turn provides a propulsive thrust. In order to maintain a constant drive thrust output, in this context, it is absolutely necessary to provide suitable measures for neutralizing the positively charged propellant ion beam or jet emitted from the engine. Preferably, a gas discharge arrangement serves as a neutralizer, in that it is used as an electron source providing electrons that neutralize the positively charged ions.

Along these lines, it is already known to provide a cathode tube having a gas flowing therethrough and an anode that is referred to as a keeper electrode, and to generate a hollow cathode gas discharge therebetween. Then, free electrons are extracted from this hollow cathode gas discharge and are then coupled into the beam or jet of the emitted propellant ions in a suitable manner so as to neutralize the positive ions.

In an arrangement of the above described type, in order to initiate the gas discharge between the anode and the cathode it is necessary to heat up the cathode relatively strongly, so that the emitted electrons have a tendency to ionize the gas flowing through the cathode tube, due to the applied anode voltage, and thereby initiate the discharge process. Such a cathode is generally made of a material having a high electron emission capacity, such as impregnated tungsten for example, and it is typically necessary to heat such a cathode to a temperature of approximately 1200° C. Not only does this heating require a considerable expenditure of energy, but the required high cathode temperature leads to high loads and demands being placed on the material, which in turn leads to accelerated and early material fatigue. Moreover, it is necessary to provide a relatively complex and costly arrangement of the entire apparatus, to ensure that it will be thermally and mechanically stable under the high temperature loading conditions and the resulting great temperature gradient and variation. Also, this known apparatus requires a high throughput or flow rate of the gas in order to initiate and maintain the ignition.

SUMMARY OF THE INVENTION

In view of the above, it is an object of the invention to provide an electrostatic propulsion engine and particularly an ionic engine which is improved so as to achieve the lowest possible material loading of the components, and thereby achieve a high reliability. It is a further object of the invention to provide such an engine that has a simple design and construction, yet is directed toward achieving a nearly steady state or equilibrium operating condition after ignition has been achieved. The invention further aims to avoid or overcome the disadvantages of the prior art, and to achieve additional advantages, as apparent from the present specification.

The above objects have been achieved according to the invention in an electrostatic engine having an improved electron source for neutralizing the positively charged ions of the propellant ion stream or jet. Particularly, the electron source comprises an anode, a hollow cathode tube, and an auxiliary electrode arranged within the interior space of the cathode tube. A pulsed discharge can be initiated between the auxiliary electrode and the cathode in order to ignite the gas discharge between the anode and the cathode.

In a preferred embodiment of the engine according to the invention, the auxiliary electrode comprises a cylindrical rod or pin that is arranged along the lengthwise axis of the hollow cathode tube. The initiating or triggering effect of the pulsed discharge between the auxiliary electrode and the cathode in turn ignites the gas discharge between the anode and the cathode. As a result, the cathode temperature required for the ignition is considerably less than the cathode temperature needed in conventional engines of this type, due to the substantially lower electron current that is required. In addition to this primary advantage according to the invention, another advantage is the reduced heating energy that must be expended for achieving the ignition, due to the lower heating temperature simultaneously, the quantity or rate of gas flowing through the hollow cathode for this process can be substantially reduced.

BRIEF DESCRIPTION OF THE DRAWINGS

In order that the invention may be clearly understood it will now be described in connection with an example embodiment, with reference to the accompanying drawings, wherein.

DETAILED DESCRIPTION OF PREFERRED EXAMPLE EMBODIMENTS AND OF THE BEST MODE OF THE INVENTION

Figure 1:
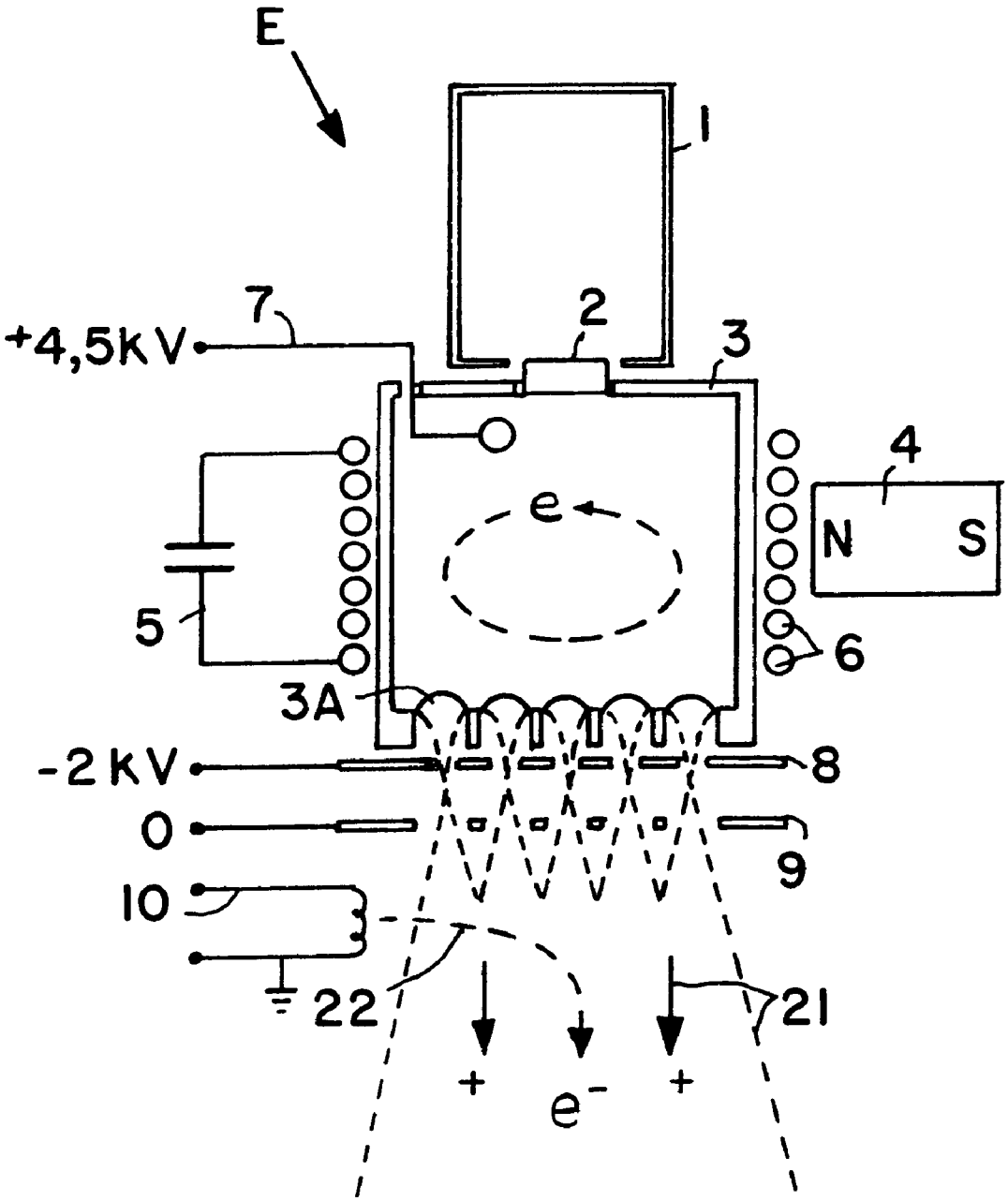
FIG. 1 schematically shows the principle construction of an electrostatic ion engine according to the invention.

In the electrostatic propulsion engine or particularly the ion engine E shown in FIG. 1, a gas that is carried along in a supply container or tank 1, such as xenon gas in the present example embodiment, is emitted from the supply container 1 through a porous fritted member or frit 2 into a chamber 3 serving as an ionizing chamber 3. This chamber 3 is surrounded by a permanent magnet 4 and by a coil-shaped induction cathode 6 that is coupled to a resonant oscillating circuit 5. Moreover, an electron extraction anode 7 is arranged in the interior of the ionizing chamber 3.

Ion outlet openings 3A are provided at the end of the ionizing chamber 3 opposite the gas inlet provided by the porous fritted member 2. An extraction or acceleration cathode 8 is arranged in front of the outlet openings 3A. A shielding electrode 9, also known as a retarding or decelerating electrode 9, is arranged spaced from the external extraction cathode 8. Moreover, a neutralizer 10 in the form of an electron source is arranged in this area adjacent to the retarding electrode 9 outside of and downstream from the outlet openings 3A of the ionizing chamber 3. The particular construction of the electron source or neutralizer 10 according to the invention will be described in detail below with reference to FIG. 2.

Figure 2:
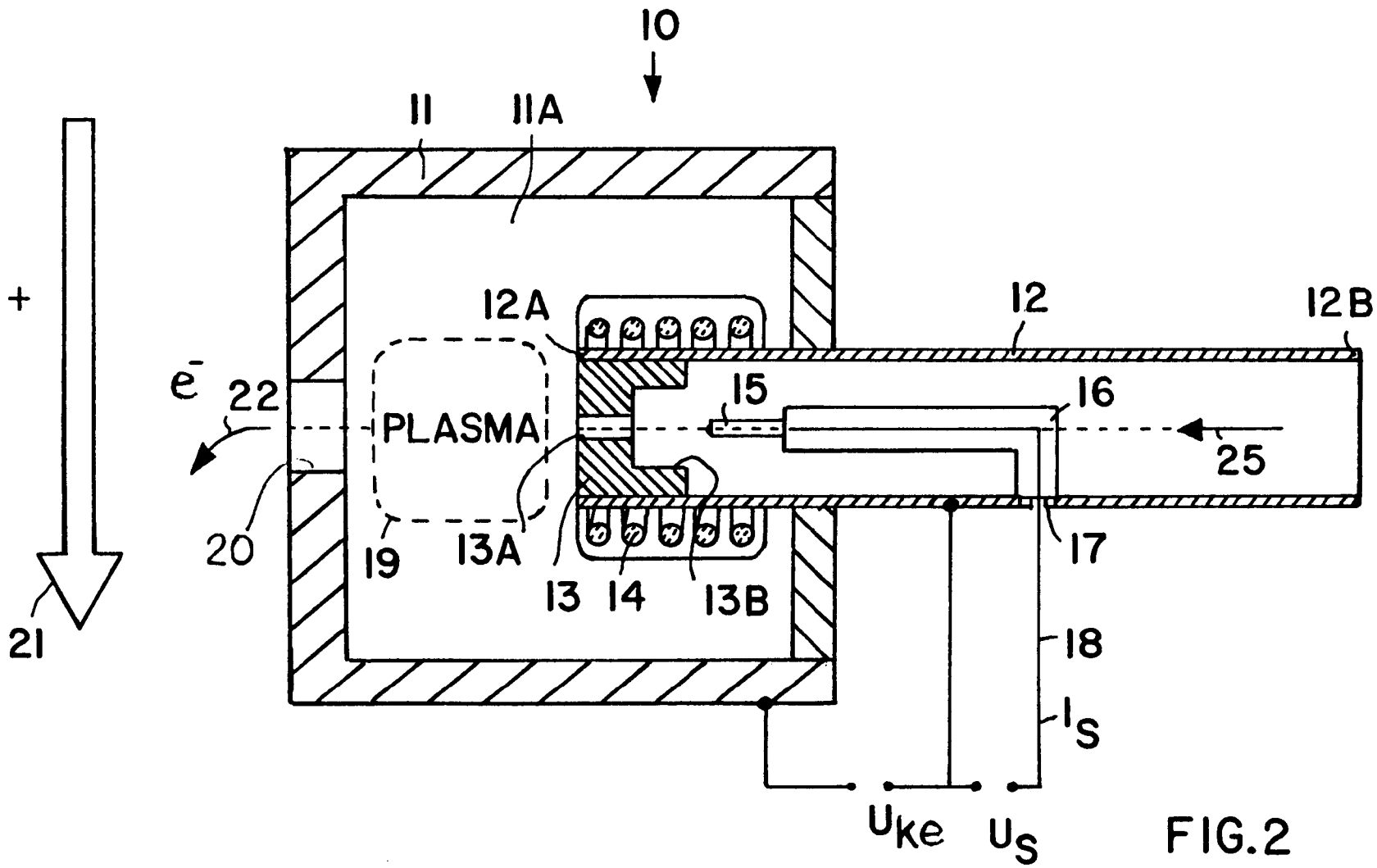
FIG. 2 schematically shows a sectional view of an electron source for an electrostatic ion engine according to the invention.

The ionic engine E is circuit-connected and energized in a generally typically manner. Namely, a positive voltage of 4.5 kV, for example, is applied to the extraction anode 7, while an accelerating voltage of −2 kV is applied to the external extraction cathode 8, and the retarding electrode 9 is set to ground or zero potential. Due to such an energization of the electrodes, as well as the operation of the induction arrangement including the permanent magnet 4, the resonant oscillating circuit 5, and the induction cathode or coil 6 surrounding the ionizing chamber 3, the gas entering the chamber 3 from the supply container 1 becomes ionized while the freed electrons are extracted or "sucked away" by the extraction anode 7 arranged in the ionizing chamber 3, and then the resulting positively charged gas ions are accelerated under the influence of the accelerating field applied between the extraction anode 7 and the extraction cathode 8. As a result, these charged gas ions leave the chamber 3 with a high energy through the outlet openings 3A. After passing through openings in the extraction cathode 8 and the retarding electrode 9, the gas ions are neutralized by a beam, jet or flow of electrons provided by the electron source 10 acting as a neutralizer. A particular construction of the neutralizer 10 is schematically shown in FIG. 2. An anode 11 is configured as a housing 11 enclosing an interior space 11A therein. The housing anode 11 is also referred to as a keeper. A cathode tube 12 is arranged with its outlet end 12A extending into the interior space 11A and its opposite inlet end 12B opening outside of the housing anode 11. An actual cathode element 13 provided at and bounding the outlet end 12A of the cathode tube 12 is located within the interior space 11A of the housing 11, and is surrounded by a heating coil or spiral 14. The cathode element 13 has a hollow cup shape, with a stepped diameter bore extending axially there-through, including a larger diameter bore portion 13B and a smaller diameter bore portion 13A. A pin- or rod-shaped auxiliary electrode 15 is supported on a mounting member 16 in the hollow interior of the cathode tube 12, so as to extend along the lengthwise axis of the cathode tube 12, with a tip of the electrode 15 facing toward the cathode element 13 at a longitudinal spacing therefrom. The mounting member 16 is secured to, but electrically insulated from, the cathode tube 12 by means of an insulating insert 17. The inlet opening 12B of the cathode tube 12 is provided with a flow of a gas, such as xenon in the present example embodiment, as indicated by the arrow 25. The gas flow 25 flows through the cathode tube 12 and through the central bores 13A and 13B of the cathode element 13 into the interior space 11A of the anode housing 11.

The anode 11, cathode 12, 13 and auxiliary electrode 15 are connected by an electric circuit 18, which applies an operating voltage $U_{ke}$ between the anode 11 and the cathode tube 12, and the cathode 13 which is conductingly connected to the cathode tube 12. The electric circuit 18 is further adapted to apply a pulsed starting voltage $U_s$ between the cathode 12, 13 and the auxiliary electrode 15 so as to cause a corresponding current $I_s$ to flow. Namely, in order to ignite the electron source 10, the cathode 13 is heated using the heating coil 14, a flow 25 of gas such as xenon is caused to flow through the cathode tube 12, and then a pulsed discharge $U_s/I_s$ is triggered for a short duration, i.e. temporarily, between the auxiliary electrode 15 and the cathode tube 12 and/or the cathode 13. This pulse discharge, in turn, ignites the gas discharge between the anode 11 and the cathode 13.

As a result, a plasma 19 is generated in the interior 11A of the anode housing 11 in front of the cathode 13 at the end of the cathode tube 12. A flow 22 of electrons $e^-$ is emitted from the plasma 19 through the outlet opening 20 of the anode housing 11 and penetrate into the ion beam or jet 21 emitted by the ionizing and accelerating arrangement as discussed above. The electrons $e^-$ 22 serve to neutralize the ions of the ion beam or jet 21.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. An electrostatic propulsion engine comprising:

a propellant gas ionizer with an ion outlet;

a propellant gas ion accelerator that is arranged adjacent to said ion outlet of said ionizer and that is adapted to output an accelerated ion jet; and an electron source that is arranged adjacent to said accelerator and that comprises an anode, a hollow cathode with a hollow space therein adapted to have an electron source gas flow therethrough, an auxiliary electrode arranged in said hollow space of said hollow cathode, and an electron outlet arranged and adapted to output electrons into said accelerated ion jet so as to at least partially neutralize said accelerated ion jet, wherein said auxiliary electrode and said hollow cathode are adapted to initiate a pulse discharge therebetween so as to ignite a gas discharge between said anode and said hollow cathode.

2. The electrostatic propulsion engine according to claim 1, wherein said electrostatic propulsion engine is adapted as an ion engine suitable for space vehicles.

3. The electrostatic propulsion engine according to claim 1, wherein said hollow cathode comprises a hollow cathode tube having said hollow space therein and having said auxiliary electrode arranged in said hollow space therein.

4. The electrostatic propulsion engine according to claim 3, wherein said auxiliary electrode comprises a cylindrical electrode rod that is supported to extend along a longitudinal axis of said hollow cathode tube in said hollow space.

5. The electrostatic propulsion engine according to claim 4, wherein said hollow cathode tube has an inlet end adapted to have said electron source gas introduced thereinto and an outlet end opposite said inlet end, and said hollow cathode further comprises a hollow cathode element arranged in said outlet end of said hollow cathode tube at an axial spacing away from said auxiliary electrode along said longitudinal axis.

6. The electrostatic propulsion engine according to claim 5, wherein said cathode element has a stepped bore extending axially therethrough with a larger inner diameter toward said auxiliary electrode and a smaller inner diameter away from said auxiliary electrode.

7. The electrostatic propulsion engine according to claim 3, wherein said hollow cathode tube has an inlet end adapted to have said electron source gas introduced thereinto and an outlet end opposite said inlet end, and said hollow cathode further comprises a hollow cathode element arranged in said outlet end of said hollow cathode tube.

8. The electrostatic propulsion engine according to claim 7, wherein said cathode element has a stepped bore extending axially therethrough with a larger inner diameter toward said auxiliary electrode and a smaller inner diameter away from said auxiliary electrode.

9. The electrostatic propulsion engine according to claim 1, further comprising said electron source gas being xenon gas flowing through said hollow cathode.

10. The electrostatic propulsion engine according to claim 1, further comprising said propellant gas and said electron source gas both being the same gas.

11. The electrostatic propulsion engine according to claim 10, wherein said propellant gas and said electron source gas are both xenon gas.

12. The electrostatic propulsion engine according to claim 1, wherein said anode of said electron source is configured as an electron source chamber enclosing an interior space therein, said hollow cathode comprises a hollow cathode tube having an inlet end opening outside of said electron source chamber and an outlet end extending into said interior space in said electron source chamber, said hollow cathode further comprises a cathode element arranged in said outlet end of said hollow cathode tube, and said electron outlet comprises an opening through said electron source chamber communicating into said interior space.

13. The electrostatic propulsion engine according to claim 12, further comprising a heating coil arranged around said outlet end of said hollow cathode tube in said interior space of said electron source chamber.

14. The electrostatic propulsion engine according to claim 1, further comprising an electrical energizing circuit that is connected between said hollow cathode and said auxiliary electrode and between said hollow cathode and said anode, and that is adapted to initiate said pulsed discharge between said auxiliary electrode and said hollow cathode and to maintain said gas discharge between said anode and said hollow cathode.

15. The electrostatic propulsion engine according to claim 1, wherein said propellant gas ionizer comprises a propellant gas tank, an ionizing chamber having a propellant gas inlet connected to said gas tank, a permanent magnet and an induction coil cathode surrounding said ionizing chamber, and an electron extraction anode arranged in said ionizing chamber, and said propellant gas ion accelerator comprises an accelerating cathode arranged adjacent to said ion outlet and a retarding electrode arranged adjacent to said accelerating cathode with said accelerating cathode between said retarding electrode and said ion outlet.

16. The electrostatic propulsion engine according to claim 15, further comprising a resonant oscillating circuit connected to said induction coil cathode, and an accelerating circuit connected to said electron extraction anode, said accelerating cathode and said retarding electrode and adapted to apply a positive potential to said electron extraction anode, a negative potential to said accelerating cathode, and a zero potential to said retarding electrode.

17. An electrostatic propulsion engine comprising:

an ionizing apparatus including an ionizing chamber with a propellant gas inlet and an ion outlet, an induction coil cathode surrounding said ionizing chamber, and an electron extraction anode arranged in said ionizing chamber and biased at a positive potential;

an ion accelerating apparatus including an accelerating cathode arranged outside of said ionizing chamber adjacent to said ion outlet and biased at a negative potential; and a neutralizing electron source that is arranged adjacent to said ion accelerating apparatus and that comprises:

an anode enclosing an electron source chamber space and having an electron outlet opening, a hollow cathode having a hollow interior, an inlet end outside of said electron source chamber space and an outlet end extending into said electron source chamber space, an auxiliary electrode arranged in said hollow interior of said hollow cathode, and an electrical energizing circuit that is connected and adapted to initiate a pulsed discharge between said auxiliary electrode and said hollow cathode, and that is connected and adapted to maintain a gas discharge between said hollow cathode and said anode.

* * * * *